US005394956A

United States Patent [19]

Hulse

[11] Patent Number: 5,394,956

[45] Date of Patent: Mar. 7, 1995

[54] SUSPENDED TENDER BOX

[76] Inventor: James M. Hulse, 2121 Walter Glaub Dr., Plymouth, Ind. 46563

[21] Appl. No.: 113,333

[22] Filed: Aug. 30, 1993

[51] Int. Cl.[6] ..... E04G 1/18

[52] U.S. Cl. ..... 182/142; 182/150

[58] Field of Search ..... 182/142, 150

[56] References Cited

U.S. PATENT DOCUMENTS

| | | | |
|---|---|---|---|
| 749,406 | 1/1904 | Spiro | 182/142 |
| 3,159,110 | 12/1964 | Wylie | 182/142 |
| 3,837,428 | 9/1974 | Gish | 182/142 X |
| 3,863,736 | 2/1975 | McWilliams | 182/142 X |
| 4,997,062 | 3/1991 | Pizzo | 182/142 X |
| 5,145,032 | 9/1992 | Puccinelli et al. | 182/142 |

FOREIGN PATENT DOCUMENTS

| | | | |
|---|---|---|---|
| 670706 | 6/1979 | U.S.S.R. | 182/150 |

*Primary Examiner*—Alvin C. Chin-Shue
*Attorney, Agent, or Firm*—James D. Hall

[57] ABSTRACT

A tender box adapted for use with a crane or other hoist device for providing an elevated working area. The tender box includes a frame and a platform with upper and lower decks. The lower deck provides a storage area for material and equipment and the upper deck defines a work area. The tender box includes a detachable test weight, which is located beneath the lower deck, and side arms and spacers, which space the tender box from the face of a vertical structure.

7 Claims, 4 Drawing Sheets

12
13
14
10
9
8
16
15
26
17
11
68
33
30
40
32
60
41
22
34
35
43
42
24
64
55
39
50
68
62
51
44
90
65
52
53
64
58
25
86
84
20
24
25

7
8
9
10
12
14
13
16
15
11
17
32
30
26
37
34
24
33
36
20
40
22
68
41
43
60
35
42
38
64
65
55
51
50
62
44
39
53
65
52
64
84
25
58
38
90
86
80
82
84

12
16
15
18
10
32
20
22
36
34
24
40
63
41
43
42
60
63
54
55
38
63
51
58
50
53
52
61
25
84
86
82
84
25
80

SUSPENDED TENDER BOX

FIELD OF THE INVENTION

This invention relates to an improved tender box adapted for suspension from a mobile crane or similar hoist device, and in particular a tender box with a double floor and front located guide rollers to maintain the tender box at a set distance from a vertical structure.

BACKGROUND OF THE INVENTION

Tender boxes, as they are commonly known, are suspended by mobile cranes or similar hoist devises to provide a stable working platform, which can be positioned next to various structures, such as buildings, towers and bridges. In many applications, tender boxes suspended from mobile cranes are safer and more versatile than conventional scaffolding. The construction and maintenance of communication towers and bridges are especially well suited for the use of mobile cranes and suspended tender boxes. A crane can position a tender box at various heights as well as quickly reposition the tender box to different locations. When properly tethered, tender boxes are generally more stable and safer with respect to handling construction materials between the ground and the elevated work area.

Conventional tender boxes have several disadvantages. Generally, cranes have difficulty positioning the tender boxes at the appropriate distance from the vertical structure. This problem is often complicated by strong wind gusts, even when the platforms are properly tethered. In addition, the rigger platform or work deck of conventional tender boxes carries not only the worker but the materials and equipment. The crowded work deck is a potential hazard. Uneven weight distribution on the work deck can cause the deck to tilt even when properly tethered.

The United State Occupational Safety and Health Agency (OSHA) sets various safety standards and operational requirements for suspended tender boxes. OSHA requires that the work deck be enclosed on all sides by a railing to prevent workers from falling between the inner edge of the rigging and the work face of the structure. Also, OSHA regulations require that after every repositioning of the mobile crane or hoist device, the tender box must be tested by raising and lowering a test load to the maximum operational height before resuming operation. Consequently, every repositioning of the crane requires the tender box to be unmanned, loaded with the test weight, raised and lowered, and then manned before work can resumed.

SUMMARY OF THE INVENTION

The tender box of this invention alleviates or eliminates several of the problems of conventional tender boxes. The tender box is designed for use in the installation of illuminated signs on communication towers, such as the illuminated signs described in my pending U.S. patent application Ser. No. 08/748,840. The tender box of this invention incorporates a dual floor design, which allows rolls of sign facing material and equipment to be stored accessibly below the upper deck. The upper deck provides a safe and uncluttered work area. The upper work area is enclosed by a permanent railing along the ends and back side and a removable chain railing across the front side. The chain railing meets the safety requirements, while minimizing the obstruction of the work area.

The tender box incorporates an adjustable guide roller to ensure that the rigging platform is suspended at the proper distance from the vertical structure on which work is being performed. With the tender box suspended in an over center position, the guide roller rests against the vertical structure. The weight of the tender box also pivots about the guide roller to maintain the horizontal position of the work area. A roll of sign facing material can be carried on a removable cross shaft support inside the lower storage compartment of the tender box. The sign facing material can be dispensed from the storage area beneath the working platform so that the facing material passes between the guide roller and the front of the rigger platform. Consequently, the workers have access to both the front of the tower and the sign facing material without comprising safety or efficiency.

The rigging platform also includes a detachable test weight mounted to the bottom of the lower deck by removable pins. The detachable test weight feature minimizes the operational down time lost during the frequent OSHA safety tests runs. The detachable test weight is also compact and allows for easy transportation.

Accordingly, an object of this invention is to provide a unique and novel tender box for suspension from a crane or other hoist device.

Another object is to provide a tender box with an extended guide roller for spacing the rigger platform at the appropriate distance from a vertical structure.

Another object is to provide a tender box including multiple decks, which define a work area, and a storage area for materials and equipment.

Another object is to provide a tender box that has a detachable test weight carried beneath the rigging frame.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 5:
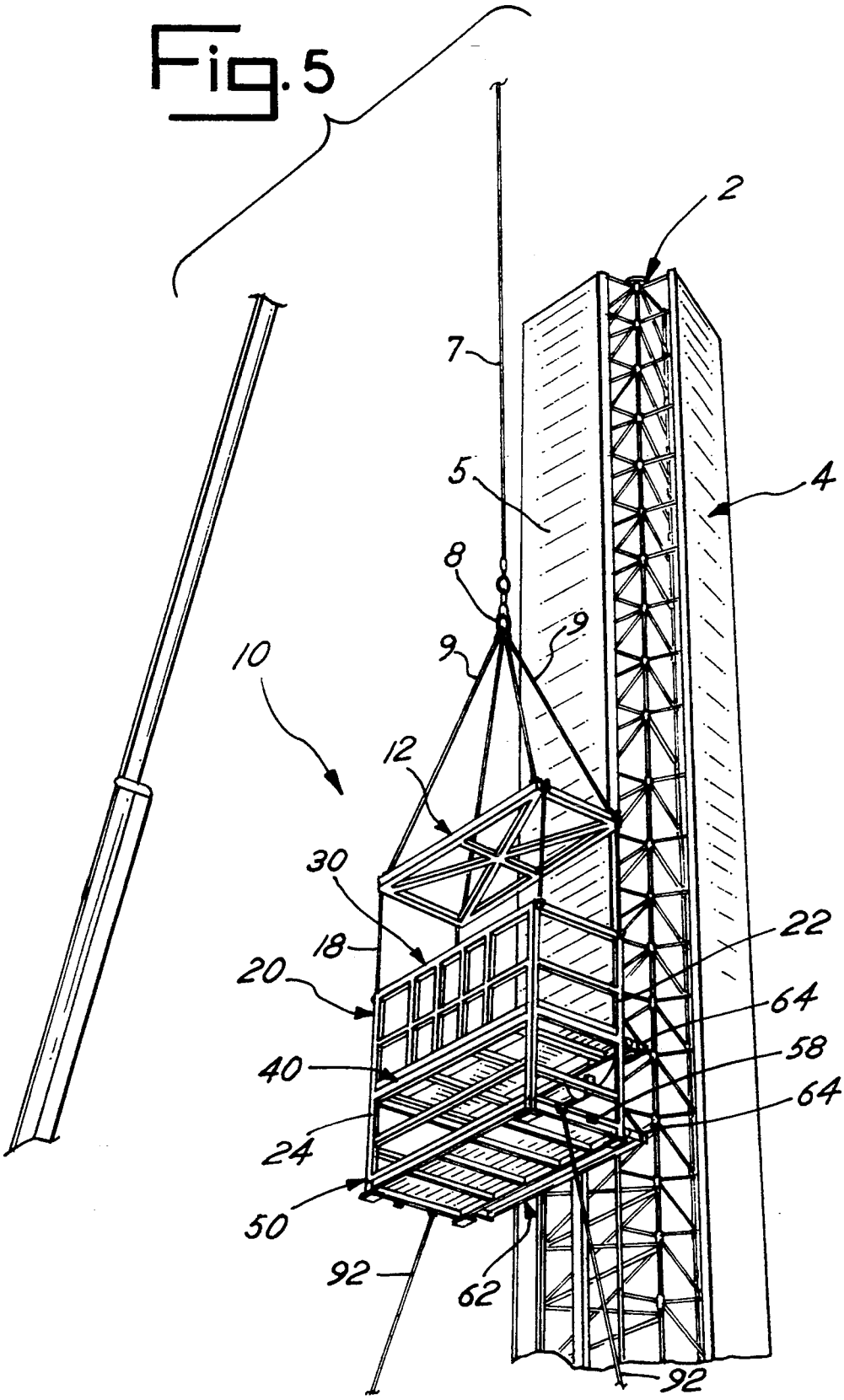
FIG. 5 is a perspective view of the tender box suspended form a crane boom adjacent a telecommunication tower.

The figures show the tender box 10 of this invention. Tender box 10 includes a lower frame 20 suspended from an upper rigging frame 12, as by cables 11. As shown in FIG. 5, Tender box 10 is generally suspended from a crane or other conventional hoist device. Conventional cranes use elongated booms 6 and a winch cable 7 to suspend the tender box.

Figure 1:
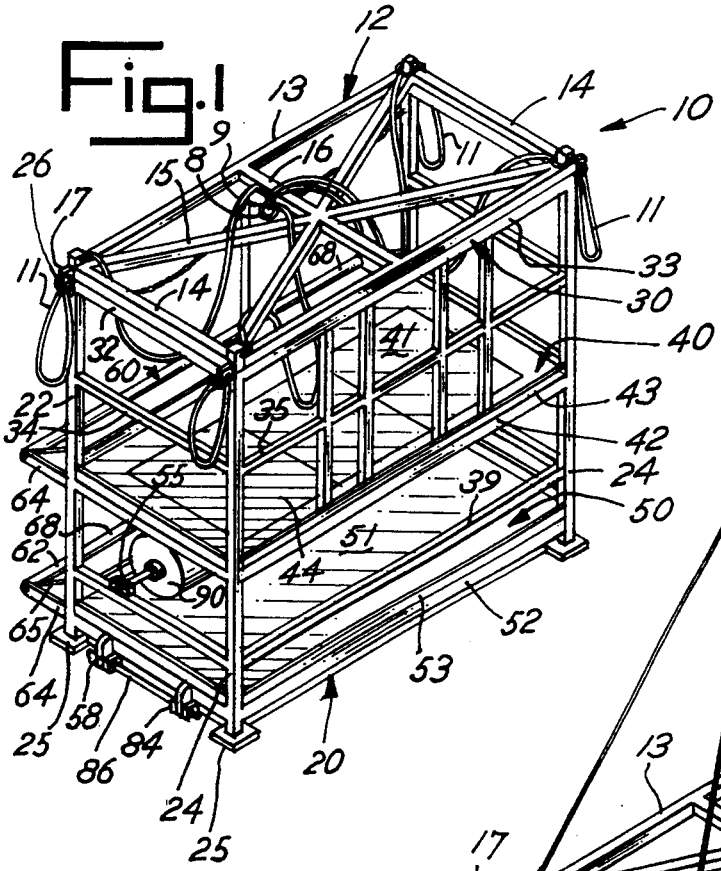
FIG. 1 is perspective view of the tender box of this invention in a collapsed transport position.
Figure 2:
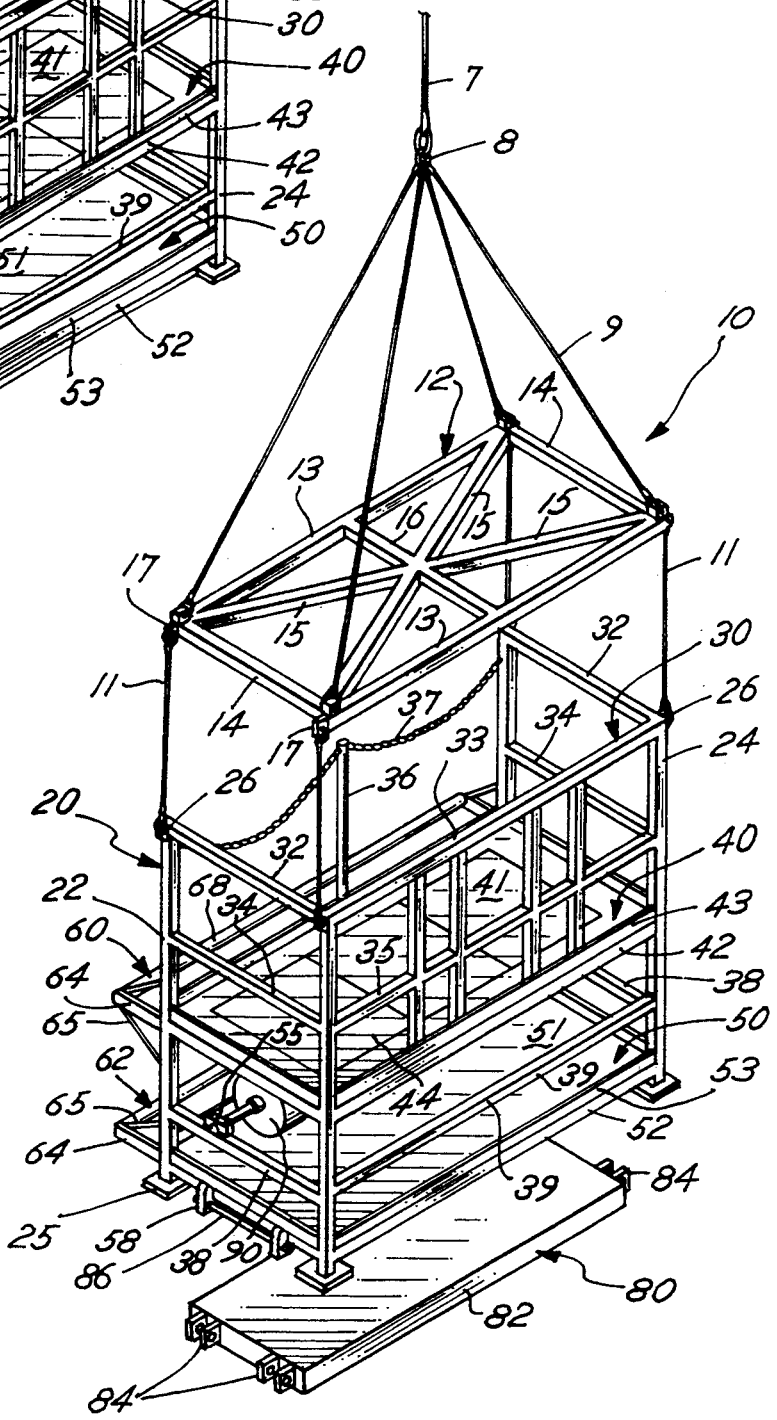
FIG. 2 is a perspective view of the tender box in a suspended position with the test weight disengaged from the rigger platform.

As shown in FIG. 2, rigging frame 12 is connected to winch cable 7 by a shackle 8 and four main rigging cables 9. Rigging cables 9 are connected to the corners of rigging frame 12. Rigging frame 12 is substantially rectangular with a pair of spaced side rails 13 connected by pair of end rails 14. Rigging frame 12 also includes a pair of diagonal cross braces 15 and center brace 16. Rigging frame 12 provides a measure of protection for the worker from falling debris. Lower frame 20 is suspended from rigging frame 12 by four corner-located suspension cables 18. Each corner suspension cable is connected to rigging frame 12 as by an eyelet 17. As shown in FIG. 1, rigging frame 12 can be secured directly atop of lower frame 20 for easy transportation.

Lower frame 20 includes a support structure defined generally by uprights 22, 24, two vertically spaced floors or decks 40, 50 and a frame cage 30. Deck 40 defines upper work area 41.

Upper work area 41 is partially enclosed along the ends and back side of frame 20 by cage 30. Cage 30 includes an upper back rail 33 connected between rear uprights 24 and a pair of upper side rails 32 connected between adjacent front and rear uprights 22, 24. Cage 30 also includes an intermediate or kick back side rail 35 connected between rear uprights 24 and a pair of intermediate side rails 34 connected between adjacent front and rear uprights 22, 24. Cage 30 prevents workers and material for falling from upper working area 41.

Figure 3:
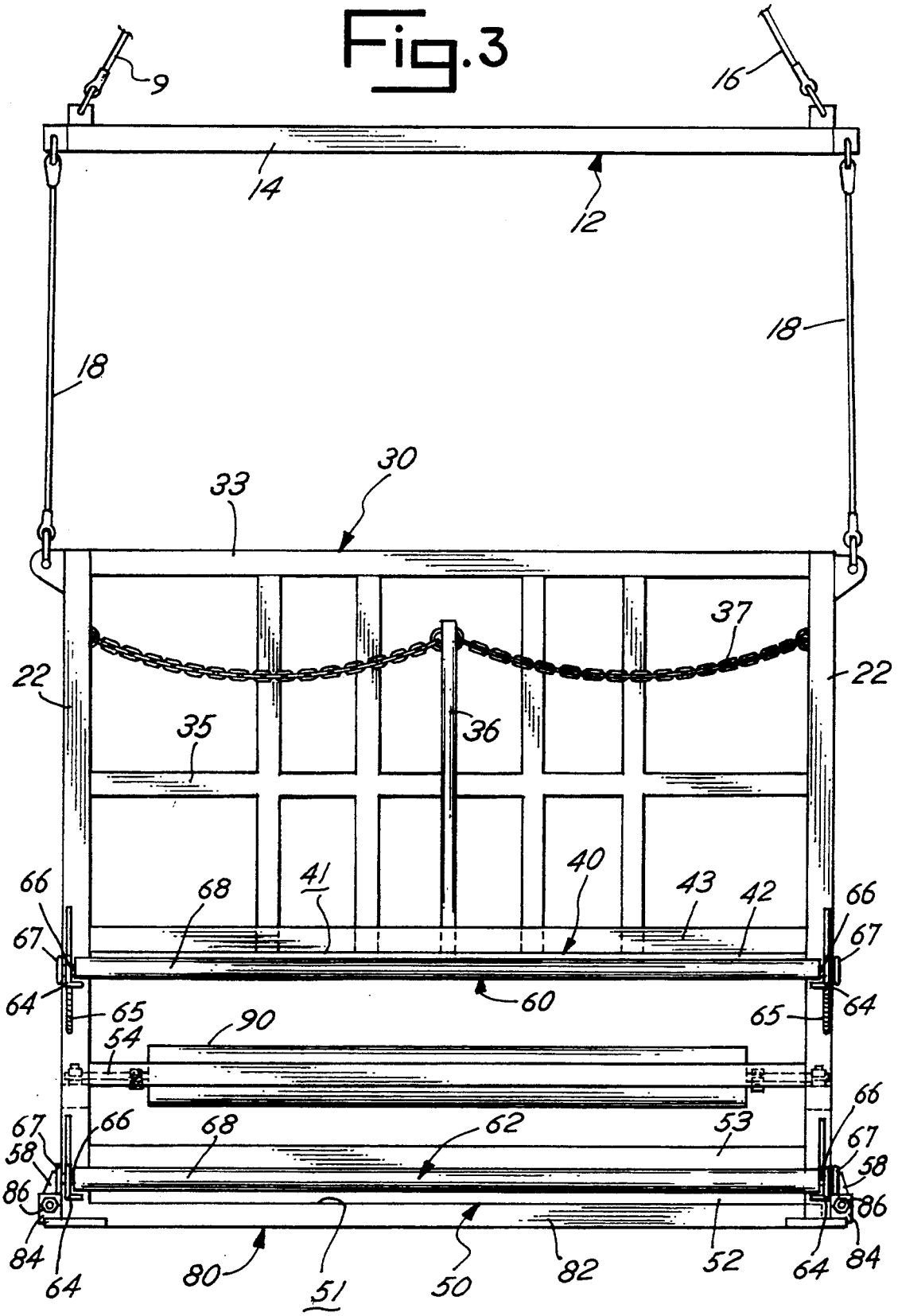
FIG. 3 is a front elevational view of the tender box in a suspended position.

Frame rails 42 are connected between uprights 22, 24. Kick plate 43 extends upwardly from rails 42 as shown and serves to prevent tools and other items from falling off deck 40. A front located center post 36 is connected to rail 42 and extends vertically from upper deck 40 along the open front face of upper working area 41. A removable chain rail 37 is suspended across the open front face of working area 41 between the front uprights 22 and center post 36, as shown in FIGS. 2 and 3. Chain rail 37 meets the OSHA safety standards and requirements for a forward safety railing and restraint, while minimizing the obstruction of the front face of work area 41.

Lower deck 50 defines lower storage area 51 which is partially enclosed by a lower end rail 39 connected between rear uprights 24 and two lower side rails 39 connected between adjacent front and rear uprights 22, 24 as shown. Lower rails 38, 39 prevent stored material from falling from lower storage area 51. Coupler 55 is mounted to each lower side rail 39. Shaft 54 is journaled between couplers 55 and may carry rolled sheeting 90.

Upper and lower decks 40, 50 are connected between front uprights 22 and rear uprights 24 to form a generally rectangular two-tiered box. Each of the uprights 22, 24 includes a foot 25 at the lower end and an eyelet 26 connected to the upper end. Suspension cables 11 are connected to eyelet 26 to suspend lower frame 20 below rigging frame 12. Lower deck 50 is supported by frame rails 52, which are connected to the lower ends of uprights 22, 24. Brackets 58 are mounted to the ends of lower deck rail 52 at the sides thereof. Lower deck 50 is spaced below upper deck 40 to define a lower storage area or compartment 51. Lower area 51 provides a storage space for equipment and material.

Upper deck 40 is supported by frame rails 42, which are connected to corner uprights 22, 24. Upper deck 41 has doors 44 (three shown), which are pivotally connected to deck 40 allow rapid access to lower storage area 51 from upper working area 41.

Figure 4:
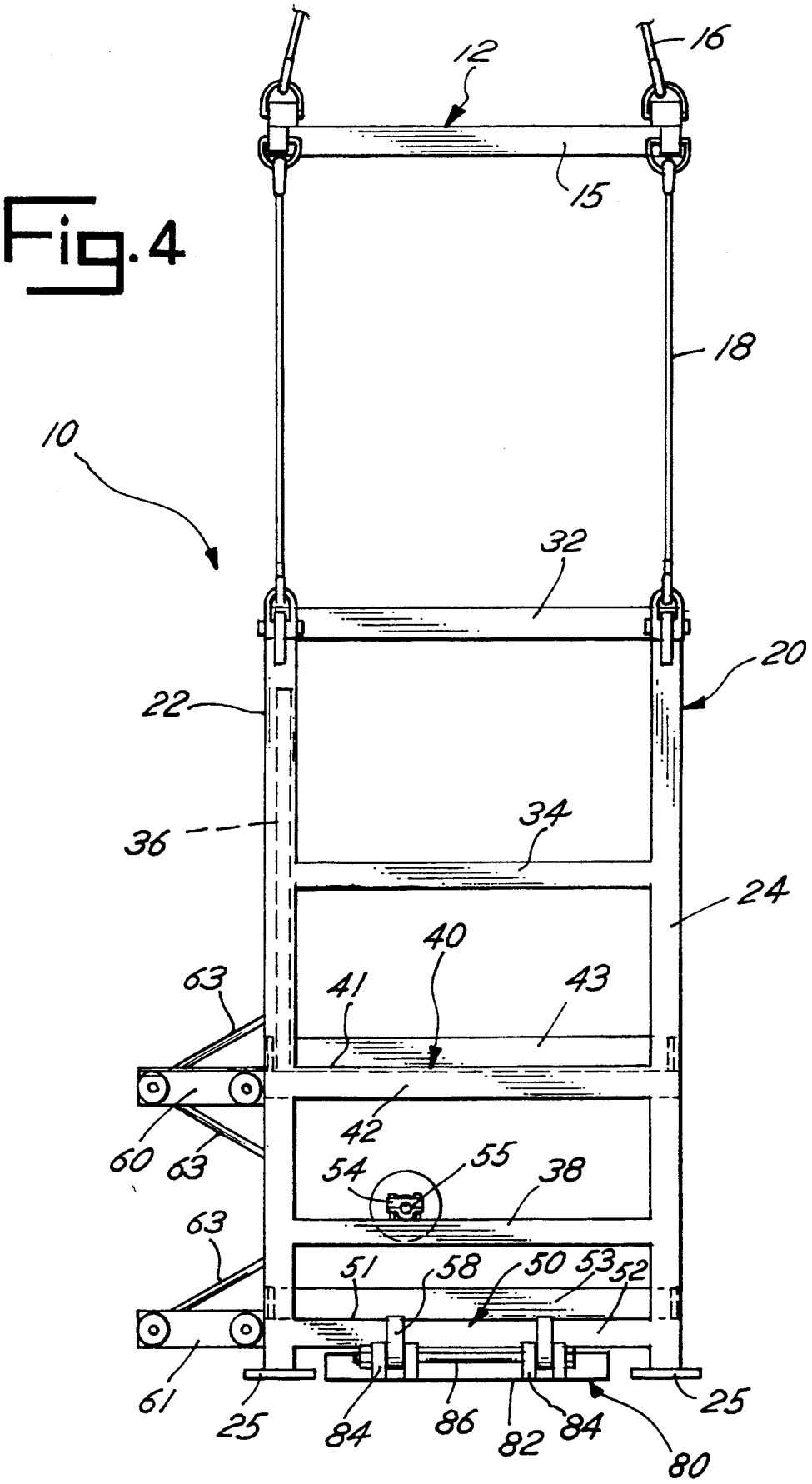
FIG. 4 is a side elevational side view of the tender box in a suspended position.

As shown in FIGS. 3 and 4, lower frame 20 also includes upper and lower spacers 60, 62, which extend across the front of the lower frame. Spacers 60, 62 are preferably rollers which are journaled between extension arms 64, which extend outwardly from each upright 22 adjacent both upper deck 40 and lower deck 50. Arms 64 are supported as by diagonal braces 65. Spacers 60, 62 may include shaft 66, which extends through aligned holes in oppositely located extension arms 64. Each shaft 66 is secured between respective guide arms 64 as by end caps 67. As shown in FIG. 4, a protective roller sleeve 68 may be loosely fitted over each shaft 66. Roller sleeve 68 is preferably constructed of a polyvinyl chloride (PVC) tubing or other suitable material, and may be easily removed for cleaning.

As shown in FIGS. 2 and 3, lower frame 20 is adapted to carry a detachable test weight 80. OSHA requires that a test weight be elevated and lowered prior to use at each relocation of the tender box 10. Test weight 80, as shown, has an elongated rectangular body 82 with ears 84 connected at each end. As shown in FIG. 4, test weight 82 is removably secured beneath lower deck frame 52 as by pins 86, which extend through aligned holes in brackets 58 and ears 84. This construction allows test weight 80 to be attached and detached quickly. Test weight 80 is designed to simulate the operational loads and verify the safety of tender box assembly 10 prior to operation. To simulate various loads, body 82 may be constructed in various dimensions and of various materials. When tender box 10 is used in operation without test weight 80, brackets 58 provide a ready attachment for tether lines 92, as shown in FIG. 5. Tether lines 92 are used to prevent tender box 10 from swaying or shifting in strong winds or load shifts on the work platform.

FIG. 5 illustrates tender box 10 being used in the erection of an illuminated sign assembly 3 mounted to a communications tower 2, such as the illuminated signs manufactured by Hulse Enterprises, Inc. of Plymouth, Ind. As shown in FIG. 5, tender box 10 is positioned adjacent tower 2 over center of one side of the sign assembly frame 4. In the over center position, spacers 60, 62 abut against the side of sign assembly frame 4. As tender box 10 is raised and lowered along one side of sign assembly frame 4, spacers 60 and 62 maintain tender box 10 at the appropriate working distance from sign assembly frame 4. The sign facing material 90 is dispensed between upper guide roller 66 and the front face of lower frame 20 as the tender box 10 is lowered along one side of the sign assembly frame 4. As tender box 10 is lowered and the sign material 90 is dispensed from the lower storage compartment, the riggers have an unobstructed work area at the proper distance at which to preform the task of erecting the sign assembly 3. Work area 41 remains uncluttered, which prevents accidental falls. Chain rail 37 prevents workers form falling between rigger platform 20 and the face of the tower 2. During operation, equipment and material in the storage area can be accessed through doors 44.

It is understood that the above description does not limit the invention to the details given, but may be modified within the scope of the following claims.

I claim:

1. A tender box assembly adapted for suspension from a hoist adjacent to a structure and for being raised and lowered by said hoist relative to said structure, said tender box including:

a frame, said frame including a platform defining a work area, railing means mounted to said frame and spaced above said platform for at least partially enclosing said work area, and a roller extending from said frame toward said structure for engagement with said structure to space said frame and platform away from said structure, said roller rotatably engaging said structure and rolling along said structure as the tender box is raised and lowered relative to said structure, and a roll of sheet material rotatably mounted on said tender box below said work area, said roll of sheet material being substantially parallel to said roller, said sheet material being dispensed from said roll and applied to said structure as the tender box is lowered along said structure.

2. The tender box assembly of claim 1 wherein said platform includes a first deck and a second deck, said work area defined in part by said first deck, said second deck spaced below said first deck to define a storage area between aid first and second decks.

3. The tender box assembly of claim 1 and a test weight mounting means carried by said platform and said mounting means for detachably mounting a test weight beneath said platform.

4. The tender box assembly of claim 1, wherein a second roller extends from said frame and extends substantially parallel to the first-mentioned roller, said tender box pivoting around one of said rollers when said one roller is engaged with the structure to maintain a substantially horizontal work area.

5. The tender box assembly of claim 1, wherein said sheet material is dispensed through a gap between said roller and said platform.

6. The tender box assembly of claim 4, wherein said platform includes an upper deck defining said work area and a lower fleck, said roll of sheet material being mounted between said decks.

7. The tender box assembly of claim 3, Wherein said test weight is an elongated rectangular body, said mounting means including a pair of brackets secured to opposite ends of said platform and extending below said platform, said test weight being substantially the same length as the distance between said brackets, said mounting means further including means carried by said test weight for securing the latter to the brackets.

* * * * *